United States Patent [19]

Gelbart

[11] 4,128,907

[45] Dec. 12, 1978

[54] MATTRESS FOUNDATION APPARATUS

[76] Inventor: Bernard Gelbart, 14301 Elgin, Oak Park, Mich. 48237

[21] Appl. No.: 632,377

[22] Filed: Nov. 17, 1975

[51] Int. Cl.[2] ..... A47C 19/00; A47C 19/04

[52] U.S. Cl. ..... 5/200 R; 5/201

[58] Field of Search ..... 5/186 R, 200 R, 201, 5/370; 297/452, 445

[56] References Cited

U.S. PATENT DOCUMENTS

| | | | |
|---|---|---|---|
| 493,147 | 3/1893 | Billington | 5/200 R |
| 2,567,619 | 9/1951 | Rosenfeld | 5/200 R |
| 3,049,729 | 8/1962 | Broyles | 5/200 R |
| 3,101,218 | 8/1963 | Baermann | 297/455 |
| 3,710,405 | 1/1973 | Watts | 5/201 |
| 3,732,585 | 5/1973 | Krembiel | 5/370 |
| 3,735,432 | 5/1973 | Kreten et al. | 5/200 R |
| 3,869,738 | 3/1975 | Lawrence | 5/200 R |

*Primary Examiner*—Mervin Stein
*Assistant Examiner*—Alex Grosz
*Attorney, Agent, or Firm*—Irving M. Weiner

[57] ABSTRACT

The mattress foundation apparatus includes a flat continuous upper component from which downwardly depend a pair of end walls and a pair of side walls. A continuous raised rim about the upper perimeter of the flat upper component retains the mattress in its desired position. A series of solid lateral struts are integrally formed with the upper component and depend downwardly therefrom. The entire mattress foundation apparatus constitutes an inelastic, downwardly opening, hollow structure useful for persons with back or orthopedic problems.

4 Claims, 6 Drawing Figures

MATTRESS FOUNDATION APPARATUS

The present invention relates generally to an inelastic, downwardly opening, hollow structure, and to methods of constructing and utilizing same.

In particular, the present invention relates to a mattress foundation apparatus which replaces conventional box springs or coil springs.

BACKGROUND OF THE INVENTION

Heretofore, there had not been developed any generally acceptable or workable mattress foundation apparatus which lent itself to easy manipulation and ready handling by the housewife, which could be economically manufactured, which would be capable of being produced by molding, which would obviate the need of the conventional coil springs or box springs, which would afford an inelastic resistance to the pressure and weight on the mattress, and which would be reliable, rigid and durable after long periods of usage. Consequently, there developed a desideratum having the aforementioned advantages and qualities, especially among individuals having back and other orthopedic problems. The apparent animadversion set forth hereinabove with respect to the prior art developments will be seen to be quite accurate and justified by directing attention to the following prior art developments discussed hereinbelow.

In 1874 John Harper was granted U.S. Pat. No. 153,075 entitled "BED-BOTTOMS" which discloses a mattress support apparatus which is more rigid than box or coil springs, but which still does not provide a rigid and continuous inelastic support for a mattress. In essence, Harper discloses combination wooden and metal springs in the form of individual spaced apart slats.

In 1893 Edward Rowcliffe Billington was granted U.S. Pat. No. 493,147 entitled "WOVEN-WIRE MATTRESS" which discloses elastic metallic mattresses which are especially useful for lunatics and persons suffering from other diseases, infants, and children. Billington discloses vertically upwardly projecting sides which stand considerably above the level of the mattress bottom.

In 1962 Horace N. Broyles was granted U.S. Pat. No. 3,049,729 entitled "BED CONSTRUCTION" which discloses a rigid support for rubber mattresses in which the support is in the form of a downwardly opening hollow shell. Broyles fails to disclose solid support members depending downwardly from the upper support surface, nor any solid support members which are integral with or contact the side walls of the support structure, nor a continuous raised ridge around the foundation apparatus.

In 1975 John Calvin Jureit and Andrew G. Seipos were granted U.S. Pat. No. 3,877,091 entitled "BED FRAME CONSTRUCTION" which discloses a bed frame having a pair of side rails, a pair of end rails, and several intermediate slats. Jureit et al fails to disclose a continuous upper component, nor a continuous raised ridge unitary with and projecting above the upper surface of the upper component of the foundation apparatus.

The present invention eliminates the disadvantages and shortcomings attendent with the conventional and prior art techniques, and at the same time provides an apparatus and method which eminently fulfills the desideratum mentioned hereinabove with a minimum of parts and at an extremely surprising reduced cost of manufacture.

SUMMARY OF THE INVENTION

The present invention provides a structure comprising a substantially planar continuous upper component, and a pair of end walls unitary with and depending downwardly from the substantially planar continuous upper component. The structure also includes a pair of side walls unitary with and depending downwardly from the planar continuous upper component.

The structure further includes a continuous raised edge unitary with and projecting above the upper surface of the substantially planar continuous upper component. Additionally, the structure is provided with a plurality of solid support members unitary with and extending from the pair of side walls, and unitary with and depending downwardly from the substantially planar continuous upper component. The substantially planar continuous upper component, the pair of end walls, the pair of side walls, the continuous raised edge, and the plurality of solid support members comprise an inelastic, downwardly opening, hollow structure.

It is an object of the present invention to provide the novel mattress foundation structures which may come in one-piece, two-piece, or three-piece constructions.

In accordance with a preferred embodiment of the present invention, there is provided a three part embodiment for converting for use from a twin bed to a full size bed structure, or from a queen size to a king size bed structure.

Yet another object of the present invention is to provide a perfectly rigid and inelastic mattress support structure which is especially beneficial for persons having orthopedic problems.

Another object of the present invention is to provide a mattress foundation apparatus which is fabricated or molded from very hard plastic which can be textured to match wood furniture in conventional bedrooms.

Another object of the present invention is to provide rigid mattress foundation structures which can be used on conventional metal bed frames either on a single level use, or in a bunk-bed type arrangement.

Other objects and details of the invention will be apparent from the following description, when read in conjunction with the accompanying drawings.

DETAILED DESCRIPTION OF SOME PREFERRED EMBODIMENTS OF THE PRESENT INVENTION

Figure 1:
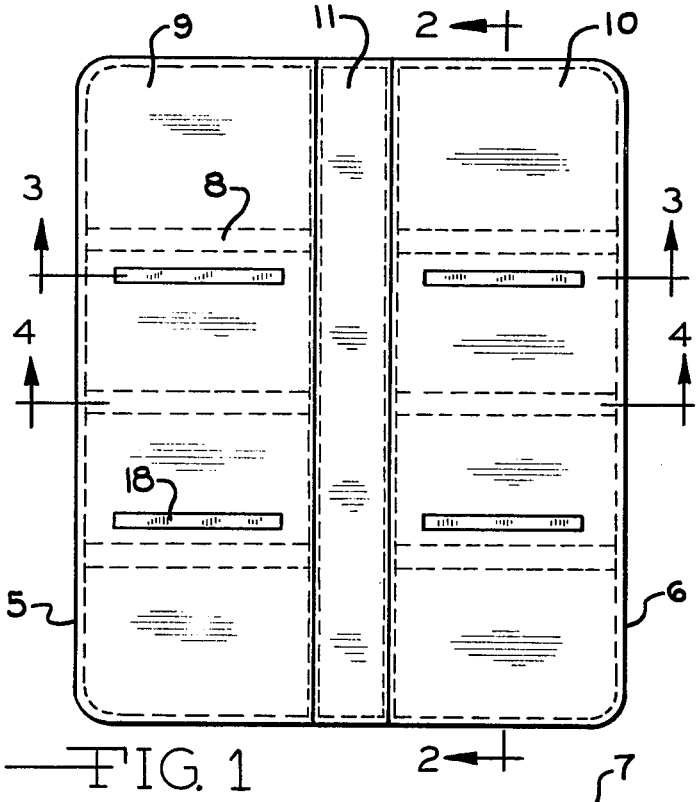
FIG. 1 illustrates a top plan view of a three-part embodiment of the present invention shown with the mattress thereon.
Figure 2:
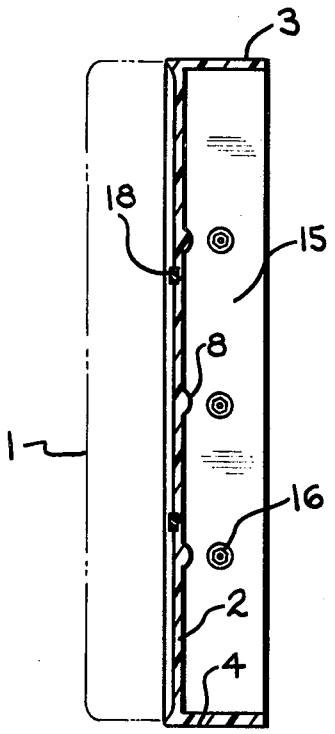
FIG. 2 depicts a section of the apparatus shown in FIG. 1 taken along the line 2—2.
Figure 3:
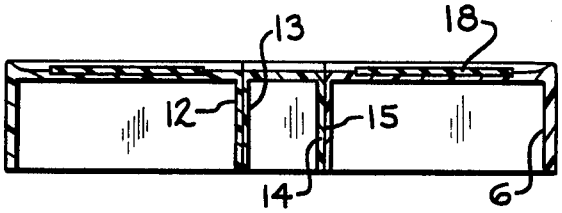
FIG. 3 represents a sectional elevational view taken along the line 3—3 of FIG. 1.
Figure 4:
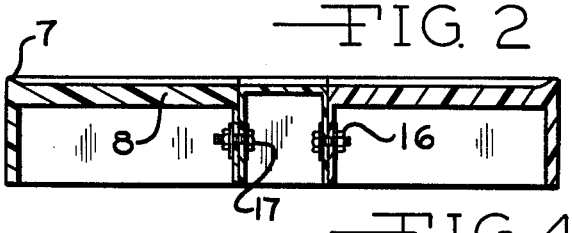
FIG. 4 illustrates a sectional elevational view taken along the line 4—4 of FIG. 1.

With reference to the three-piece embodiment shown in FIGS. 1 through 4, there is illustrated a mattress 1 resting upon a substantially planar continuous upper component, such as a support substrate 2. A pair of end walls 3 and 4 are unitary with and depend downwardly from the substrate 2. A pair of side walls 5 and 6 are also unitary with and depend downwardly from substrate 2.

Figure 6:
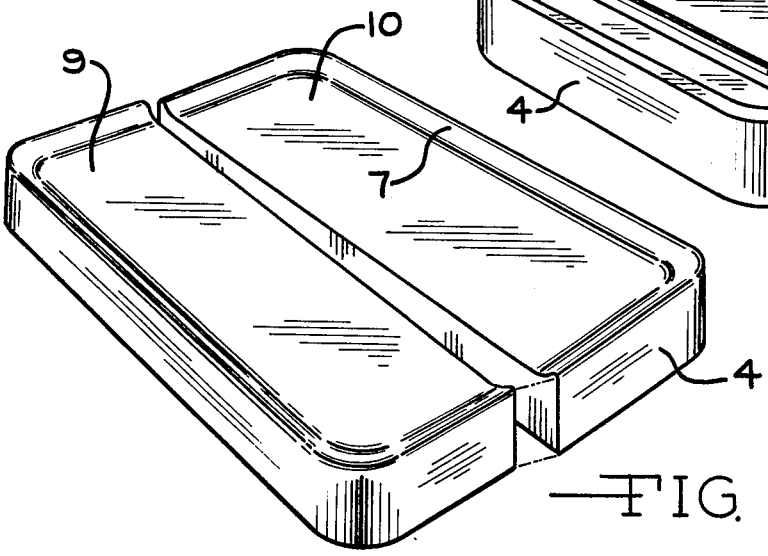
FIG. 6 illustrates a perspective view of a two-piece embodiment of the present invention.

A continuous contoured raised edge, such as a rim 7, is unitary with and projects above the uppermost surface of substrate 2 sloping upward and outward shown best in FIG. 6. A plurality of solid support members, such as lateral struts 8, are unitary with and extend from the pair of side walls 5 and 6, and are unitary with and depend downwardly from the substrate 2.

The support substrate 2, the pair of end walls 3 and 4, the pair of side walls 5 and 6, the rim 7, and the lateral struts 8 comprise an inelastic, downwardly opening, hollow structure.

The three-piece embodiment shown in FIGS. 1–4 consists of two end sections 9 and 10 and a central section 11. The mating walls 12, 13, 14 and 15 of the sections 9, 10 and 11 are provided with holes therethrough to accommodate suitable fastening means, such as nuts 16 and bolts 17.

The central section 11 can have a width of approximately 15 inches to enable converting from a twin-bed arrangement to a full-size bed arrangement as depicted in FIGS. 1 through 4, or for converting from a queen-size bed arrangement to a king-size bed arrangement. The queen-size bed arrangement is shown in FIG. 6 as a two-piece construction using only sections 9 and 10 with the central section 11 eliminated.

In all the embodiments depicted the rim 7 provides a trough within which the mattress 1 can be retained in position on the structure. Optionally, and additionally, to prevent any undesired relative motion between the mattress 1 and the support substrate 2, there may be provided a plurality of hard rubber rough surfaced inserts or friction pads 18. The friction pads 18 provide a non-slip interface between the mattress 1 and the support substrate 2.

Figure 5:
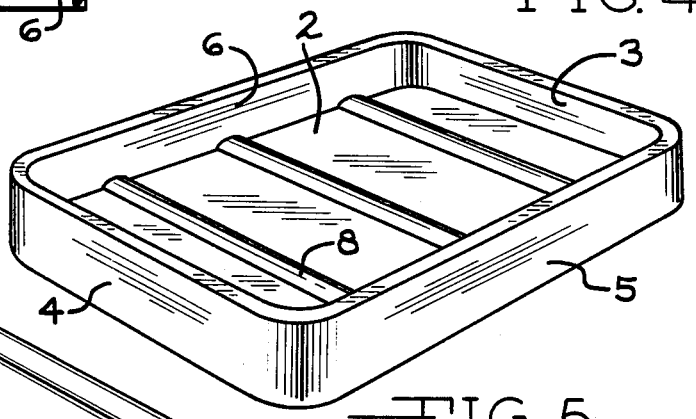
FIG. 5 depicts a perspective view of a one-piece embodiment of the present invention shown with its top side facing downwardly.

FIG. 5 illustrates a one-piece embodiment wherein the lateral struts 8 extend continuously from one side wall 5 to the other side wall 6. Such continuous lateral struts 8 provide protection against bending, buckling or warpage of the mattress foundation apparatus.

With reference to FIG. 6, there is shown a two-part embodiment, which can be expanded to accommodate a king-size bed or full-size arrangement by the use of a central section 11, as shown in FIG. 1.

It is contemplated by the present invention that the structure be molded or fabricated from a hard plastic substance, such as glass reinforced plastics, to provide a light-weight but very durable and rigid structure. Such hard plastic substance can be provided with a surface which simulates natural wood to blend in with other bedroom furniture.

In accordance with the present invention, the novel mattress foundation apparatus can be employed in place of the conventional box spring or coil spring arrangements. As indicated hereinabove, the present invention can be employed in a bunk-bed arrangement also.

The present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description. Furthermore, all changes which come within the meaning and range or equivalency of the appended claims are therefore intended to be embraced therein.

I claim:

1. A structure, including, in combination, a mattress, and comprising:

a planar continuous upper component;

a pair of end walls which are unitary with and depend downwardly from said planar continuous upper component;

a pair of side walls which are unitary with and depend downwardly from said planar continuous upper component;

a continuous contoured raised edge which is unitary with and projects above the uppermost surface of said planar continuous upper component sloping upwardly and outwardly;

a plurality of solid support members which are unitary with and extend from said pair of side walls, and which are unitary with and depend downwardly from said planar continuous upper component;

said planar continuous upper component, said pair of end walls, said pair of side walls, said continuous raised edge, and said plurality of solid support members comprising an inelastic, downwardly opening, hollow structure;

said continuous contoured raised edge constitutes a rim for retaining said mattress in position on and against said uppermost surface of said planar continuous upper component; and wherein said inelastic hollow structure is formed by a first section and a second section;

said first section having an outer side wall and an inner side wall, and having a raised edge which terminates adjacent said inner side wall;

said second section having an outer side wall and an inner side wall and having its raised inner edge terminate adjacent its inner side wall;

said inner side walls of said first and second sections being provided with mating apertures therethrough to accommodate the passage therethrough of fastening means for interconnecting said inner side walls of said first and second sections;

said raised edges of said first and second sections being so oriented and aligned when said first and second sections are assembled together that there is formed a continuous raised edge about the upper periphery of said planar continuous upper component.

2. A structure characterized substantially in accordance with claim 1, wherein:

said planar continuous upper component is provided with a plurality of friction pad inserts which form a portion of said uppermost surface of said planar continuous upper component.

3. A structure characterized substantially in accordance with claim 1, wherein:

said inelastic hollow structure is formed from first, second and third sections;

said first section including an outer side wall and an inner side wall, and having its raised edge terminating adjacent said inner side wall;

said second section including an outer side wall and an inner side wall and having its raised edge terminating adjacent its inner side wall;

said third section including a pair of parallel side walls and having its raised edge terminating adjacent its side walls;

said side walls of said third section and the inner side walls of said first and second sections being provided with mating apertures for accommodating the passage therethrough of fastening means for assembling said first, second and third sections together; and said raised edges of said first, second and third sections forming a continuous raised edge around the upper periphery of said planar continuous upper component for confining said mattress within said continuous raised edge.

4. A structure characterized substantially in accordance with claim 3, wherein:

said planar continuous upper component is provided with a plurality of friction pad inserts which form a portion of said uppermost surface of said planar continuous upper component.

* * * * *